US009696018B2

(12) United States Patent
Ma

(10) Patent No.: US 9,696,018 B2
(45) Date of Patent: Jul. 4, 2017

(54) LIGHT EMITTING DIODE LUMINAIRE COMPATIBLE FOR BOTH TOP MOUNTING AND WALL MOUNTING

(71) Applicant: Shenzhen Yaorong Technology Co., Ltd., Shenzhen, Guangdong province (CN)

(72) Inventor: Zhiping Ma, Shenzhen (CN)

(73) Assignee: Shenzhen Yaorong Technology Co., Ltd., Shenzhen (CN)

( * ) Notice: Subject to any disclaimer, the term of this patent is extended or adjusted under 35 U.S.C. 154(b) by 82 days.

(21) Appl. No.: 14/831,861

(22) Filed: Aug. 20, 2015

(65) Prior Publication Data

US 2016/0363300 A1 Dec. 15, 2016

(30) Foreign Application Priority Data

Jun. 9, 2015 (CN) ..... 2015 2 0391652

(51) Int. Cl.

| | |
|---|---|
| ***F21V 21/00*** | (2006.01) |
| ***F21V 21/108*** | (2006.01) |
| ***F21S 8/00*** | (2006.01) |
| ***F21S 8/04*** | (2006.01) |
| *F21V 5/04* | (2006.01) |
| *F21V 5/00* | (2015.01) |
| *F21V 29/77* | (2015.01) |
| *F21V 29/83* | (2015.01) |
| *F21Y 105/10* | (2016.01) |
| *F21Y 115/10* | (2016.01) |

(52) U.S. Cl.

CPC ..... *F21V 21/108* (2013.01); *F21S 8/036* (2013.01); *F21S 8/043* (2013.01); *F21V 5/007* (2013.01); *F21V 5/048* (2013.01); *F21V 29/773* (2015.01); *F21V 29/83* (2015.01); *F21Y 2105/10* (2016.08); *F21Y 2115/10* (2016.08)

(58) Field of Classification Search

CPC ..... F21V 21/092; F21V 21/08; F21V 17/102
USPC ..... 362/249.02, 368, 370, 397
See application file for complete search history.

(56) References Cited

U.S. PATENT DOCUMENTS

2006/0082993 A1* 4/2006 Hsu ..... F21S 9/02 362/197
2012/0275141 A1* 11/2012 Keith ..... F21L 4/00 362/158

* cited by examiner

*Primary Examiner* — William Carter
(74) *Attorney, Agent, or Firm* — PROI Intellectual Property US

(57) ABSTRACT

A light emitting diode luminaire compatible for both top mounting and wall mounting comprises a mounting adapter body suitable to top mounting and wall mounting of the luminaire, a power source for power supply to the luminaire, a radiator, a light source plate, a sucking plate and/or an arm; the mounting adapter body comprises a mounting adapter bracket centered thereof, the mounting adapter bracket can not only be connected to the sucking plate but also connected to the arm. Under the cooperation between the long striped mounting adapter body and the sucking plate and/or arm, the same luminaire can be applicable to a variety of different ways of mounting, with only a few components rather than a complete set of components changed. Thus, not only the procedure and time of production are simplified, but the production cost is greatly reduced.

9 Claims, 8 Drawing Sheets

LIGHT EMITTING DIODE LUMINAIRE COMPATIBLE FOR BOTH TOP MOUNTING AND WALL MOUNTING

CROSS REFERENCE TO RELATED APPLICATIONS

The present application claims priority to Chinese Patent Application CN201520391652.2 filed on Jun. 9, 2015.

TECHNICAL FIELD

The invention relates to the technical field of light emitting diode luminaires, especially relates to a light emitting diode luminaire compatible for both top mounting and wall mounting.

BACKGROUND ART

The light emitting diode luminaires in prior art usually, one style of luminaire has only one way of mounting, or a variety of different ways of mounting of one style of luminaire can only be realized when a complete set of fittings are changed. Thus, to enable one style of luminaire to have two different ways of mounting, two sets of totally different fittings are needed, while fittings needed by different ways of mounting can't be shared, giving rise to the increased complexity of the production procedure of the luminaire, low production efficiency and high cost.

Under the condition of ensuring the excellent properties of the luminaire, the invention enables one style of luminaire to apply to different mounting environments, by only matching a few interface mounting components with a shared and compatible component—a mounting adapter body for both top mounting and wall mounting. With such compatible design, components are greatly simplified, quantity of components compatible for different ways of mounting is maximized, production becomes much easier and quicker, production efficiency is improved and production cost is greatly reduced.

CONTENTS OF THE INVENTION

The technical problem the invention aims to settle lies in avoiding the deficiencies of the prior art so as to provide a light emitting diode luminaire compatible for both top mounting and wall mounting prior art the deficiencies of the prior art including. fittings required for realizing different ways of mounting can't be shared, low production efficiency and high cost. In the luminaire, a mounting adapter body compatible for both top mounting and wall mounting is designed as a shared component, complexity of components realizing different ways of mounting is lowered, production becomes easier and quicker, production efficiency is improved and production cost is greatly reduced.

Technical solution adopted by the invention to solve the said technical issues shall be: A light emitting diode luminaire compatible for both top mounting and wall mounting, wherein it comprises a mounting adapter body suitable for top mounting and wall mounting of the light emitting diode luminaire, a power source for converting an external power supply into a voltage supply for use of the luminaire, a radiator for facilitating heat dissipation of the luminaire, and a light emitting diode light source plate for effecting illumination of the light emitting diode luminaire; wherein the light emitting diode luminaire further comprises a sucking plate for fixing the light emitting diode luminaire to a mounting surface by top mounting and/or an arm for fixing the light emitting diode luminaire to a mounting surface by wall mounting; wherein said mounting adapter body comprises at its central part a mounting adapter bracket capable of being connected to not only the sucking plate but also the arm.

Further an upper part of said mounting adapter bracket is provided with mounting slots for connecting said mounting adapter bracket to the sucking plate; wherein a lower surface of said sucking plate is arranged with two rectangular facades which are perpendicular to the sucking plate; wherein the two rectangular facades are arranged with mounting beams protruding towards the center of the sucking plate; wherein said mounting beams can enter the mounting slots from one end of said mounting slots and are clamped into said mounting slots.

The said mounting beams are arranged with holes for fixing the mounting beams.

The two seamed edges thereof being symmetrically distributed with protruding buckle structures; wherein one side of said mounting adapter bracket is provided with a square opening; wherein said side cover of the mounting adapter body is fixed to said square opening by the buckle structures.

The said mounting adapter bracket is fixedly connected to the sucking plate and the arm by fasteners.

The said mounting adapter body further comprises a rectangular cover for covering an upper opening of the arm and a wire cover for covering an upper opening of the mounting adapter bracket; an end of said arm is connected to the mounting adapter bracket via fasteners; another end of said arm is arranged with holes for fixing the arm to the mounting surface.

The said luminaire body mounting adapter body further comprises a mounting bracket; said radiator further comprises a pair of fastening lugs for fixing the mounting bracket; the said mounting bracket is fixed to said radiator via said fastening lugs.

The light emitting diode luminaire compatible for both top mounting and wall mounting further comprises a transparent lampshade for covering the luminaire, and a lampshade fixing connector for fixing the transparent lampshade to the radiator; wherein said radiator is fixedly connected to the mounting adapter body and said power source is fixed to the mounting adapter body; wherein said radiator comprises a radiator mounting hole post for fixing the radiator, a light source mounting surface located at the bottom of the radiator, and heat sinks distributed at the top of the radiator; said radiator is fixedly connected to the luminaire body mounting adapter body via the radiator mounting hole post; said light emitting diode light source plate is fixed to the light source mounting surface at the bottom of the radiator.

The said heat sinks are radially distributed around the center of the radiator, and convection-type heat dissipation through holes are arranged between the adjacent heat sinks; The said lampshade fixing connector comprises a silicon ring and buckles; an inner edge of a bottom surface of said radiator is arranged with a fixing slot for fixing the silicon ring; the light emitting diode light source plate is covered by said transparent lampshade; said transparent lampshade is compressed to the silicon ring which is fixed in the fixing slot; and the transparent lampshade is fixedly connected to the radiator via the buckles.

The light emitting diode luminaire compatible for both top mounting and wall mounting according further comprises a lens, light angles of which can be adjusted; wherein said lens is fixed between the transparent lampshade and the light emitting diode light source plate; wherein said transparent lampshade is conical or disc shaped.

Compared with the prior art, beneficial effects of the invention are as follows: 1. With only a few fittings changed, the invention enables the same light emitting diode luminaire to be applicable to a varieties of different ways of mounting including top mounting and wall mounting via a shareable component—a mounting adapter body compatible for both top mounting and wall mounting; 2. With the design of the above light emitting diode luminaire, installation compatibility is improved, quantity of assembly components of the luminaire is greatly reduced, production and installation procedures are simplified, production and installation time is shortened, and the cost is greatly reduced.

DETAILED EMBODIMENTS

Figure 1:
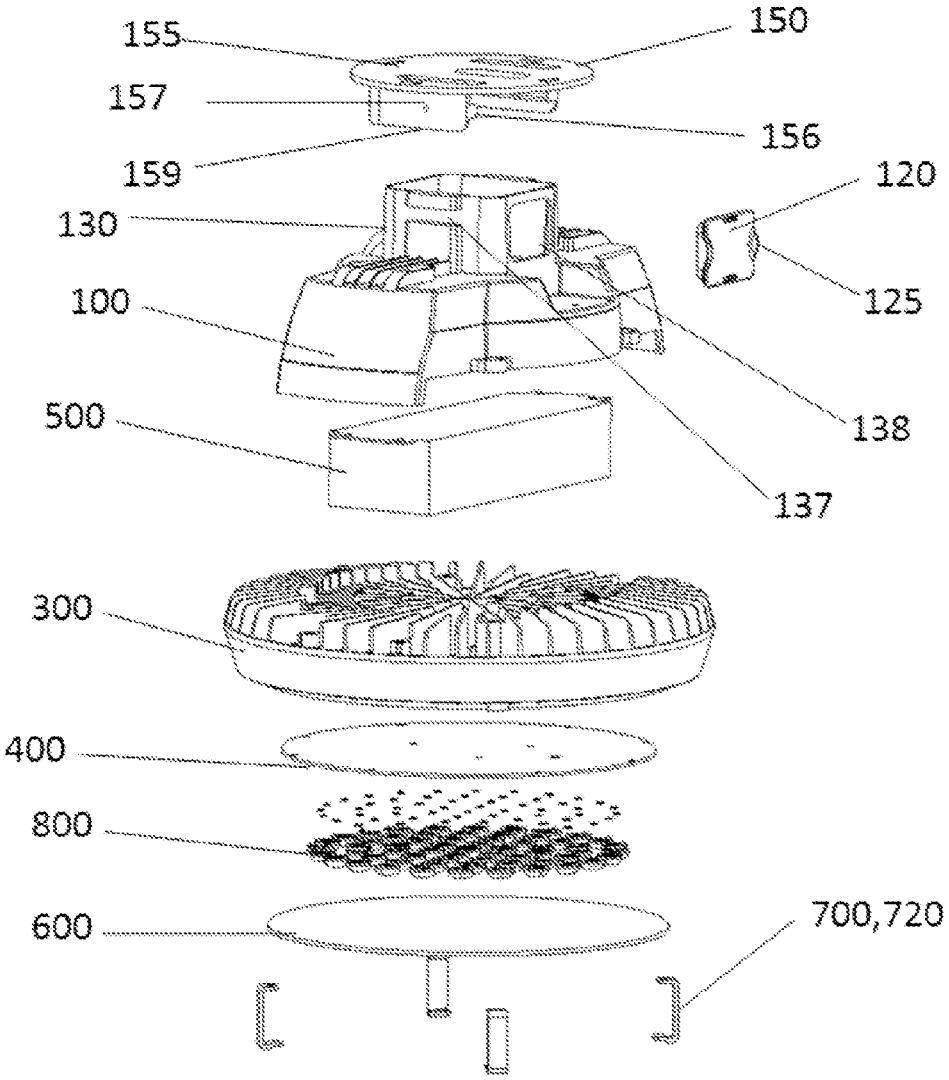
FIG. 1 shows a decomposed state diagram 1 of the first embodiment of the invention.

The following are the detailed embodiments of the invention with combination of the figures. The first preferred embodiment shown in FIG. 1 and FIG. 2 comprises a mounting adapter body 100 for adapting to luminaire mounting, a power source 500 for converting an external power supply into a voltage supply or use of the luminaire, a radiator 300 facilitating for heat dissipation of the luminaire, a light emitting diode light source plate 400 for effecting illumination of the light emitting diode luminaire, a transparent lampshade 600 for covering the luminaire and a lampshade fixing connector 700 for fixing the transparent lampshade. The power source 500 is fixed on the mounting adapter body 100; the light emitting diode light source plate 400 is fixed at the bottom of the radiator 300; the radiator 300 is fixedly connected to the mounting adapter body 100.

Figure 2:
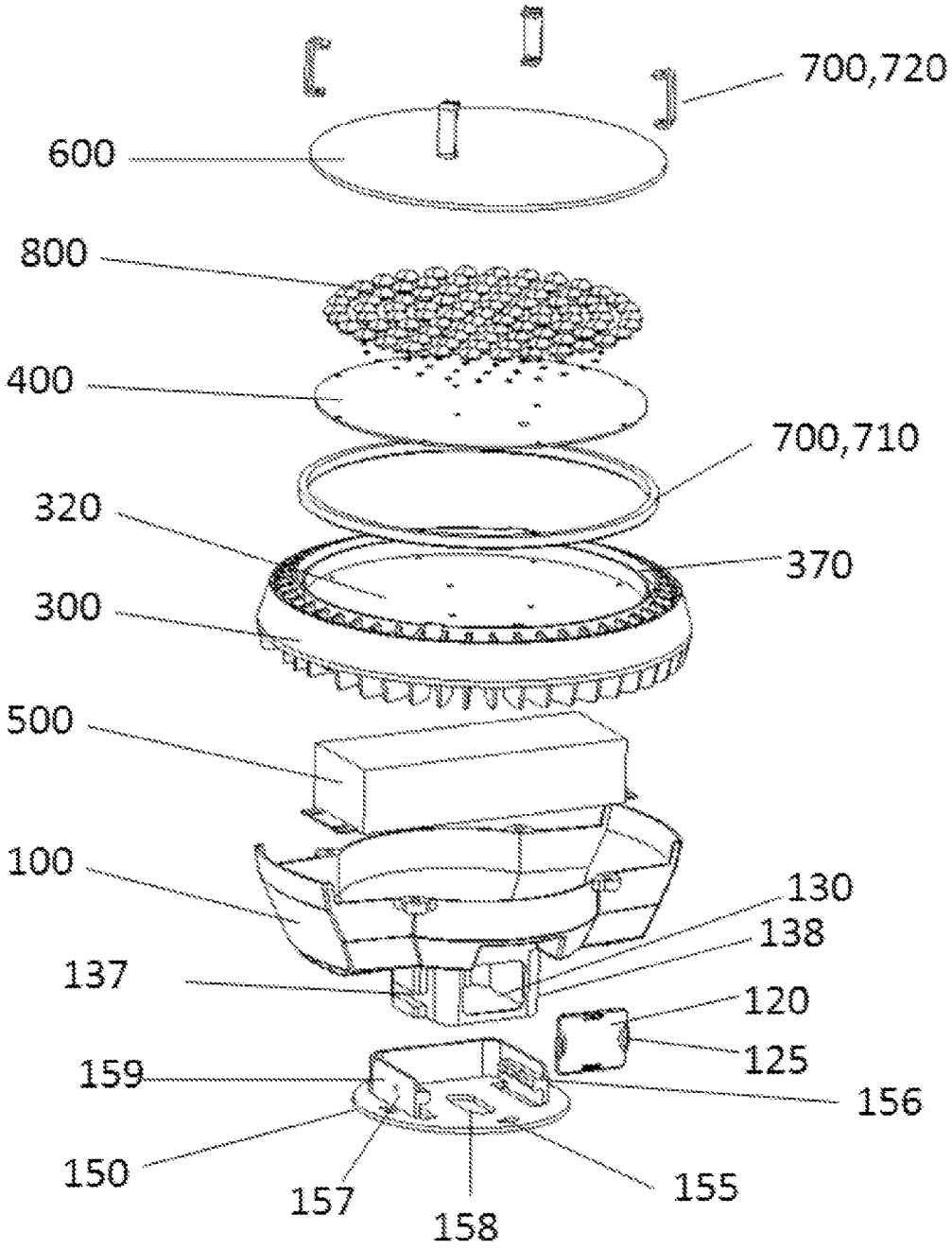
FIG. 2 shows a decomposed state diagram 2 of the first embodiment of the invention.
Figure 8:
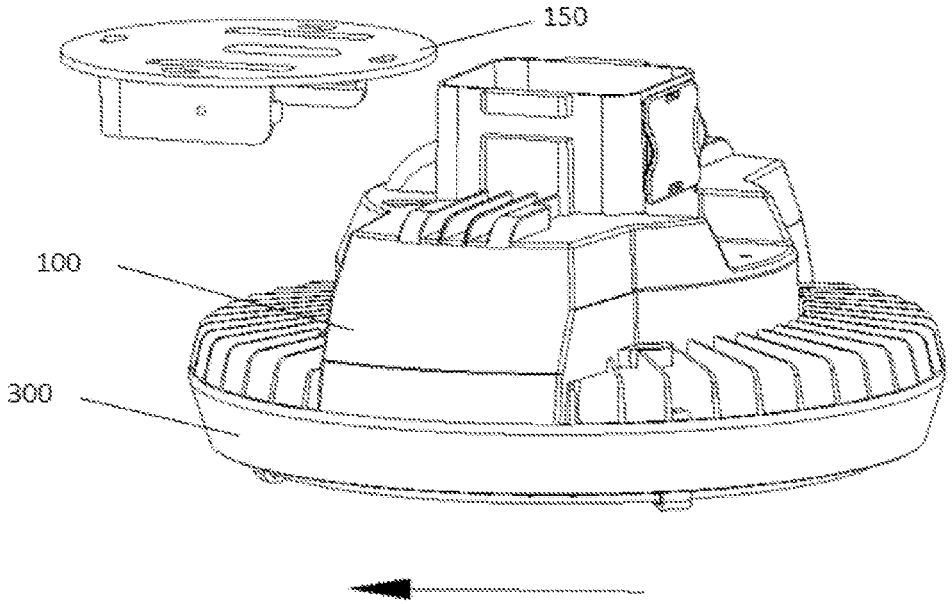
FIG. 8 shows a decomposed state diagram of the sucking plate 150 of the first of the invention, wherein the direction of arrow is the direction where the light emitting diode luminaire is pushed into the sucking plate.

As is shown in FIG. 1 and FIG. 2, the said mounting adapter body 100 comprises a rectangular mounting adapter racket 130 centered thereof; upper part of the mounting adapter racket 130 is provided with sucking plate mounting slots 137 for being connected to the sucking plate 150; lower surface of the sucking plate 150 is arranged with two rectangular facades 159 which are perpendicular to the sucking plate 150; the two rectangular facades 159 are arranged with sucking plate mounting beams 156 which are protruding towards the center of the sucking plate 150; as is shown in FIG. 8, the said sucking plate mounting beams 156 slide from one end of the said sucking plate mounting slots 137 and are clamped into the said sucking plate mounting slots 137, the sucking plate mounting slots 137 cooperate with the sucking plate mounting beams 156 by sliding push-in means. Besides, the sucking plate mounting beams 156 are fastened to the sucking plate mounting slots 137 via mounting beam fixed holes 157, so as to enhance the reliability of connection between the sucking plate mounting beams 156 and the sucking plate mounting slots 137.

Figure 3:
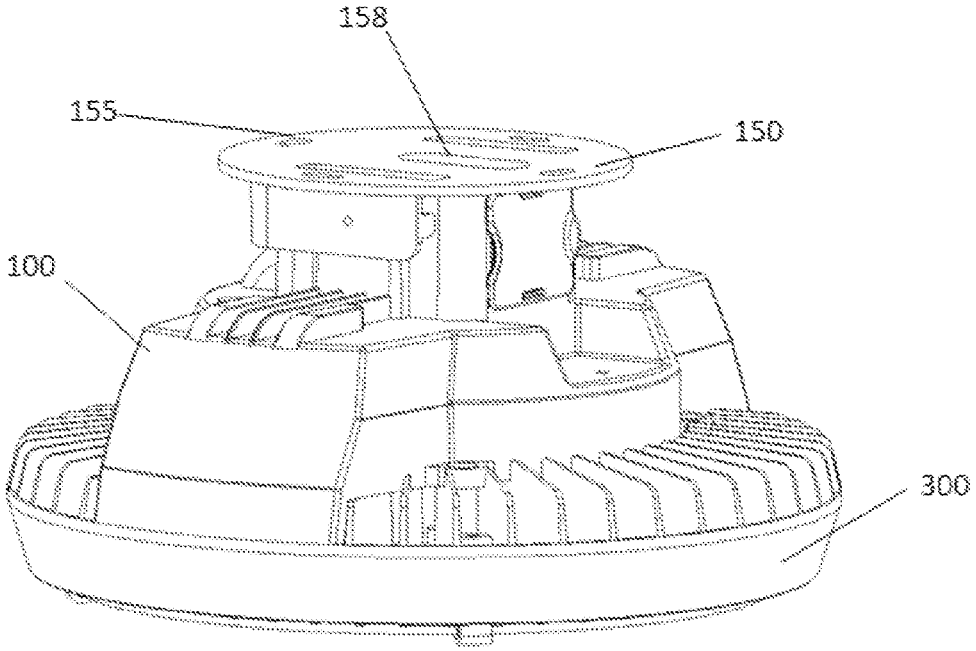
FIG. 3 shows a combined state diagram 1 of the first embodiment of the invention.
Figure 4:
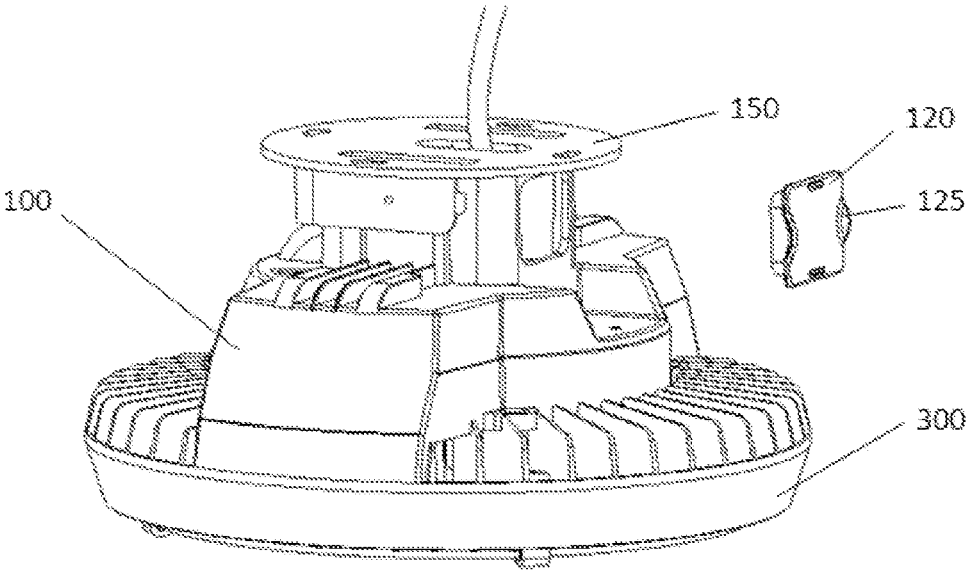
FIG. 4 shows a decomposed state diagram of the side covers 100 of the mounting adapter body of the first embodiment of the invention.

In the first preferred embodiment shown in FIG. 3 and FIG. 4, the top mounting surface of the said sucking plate 150 is arranged with top mounting through-holes 155 for fixing the light emitting diode luminaire to the mounting surface and power wire through-holes 158 for threading of power wires, there can be one or several power wire through-holes 158; the power wire through-holes 158 can also be located on the two rectangular facades 159 at the lower surface of the sucking plate 150.

Figure 5:
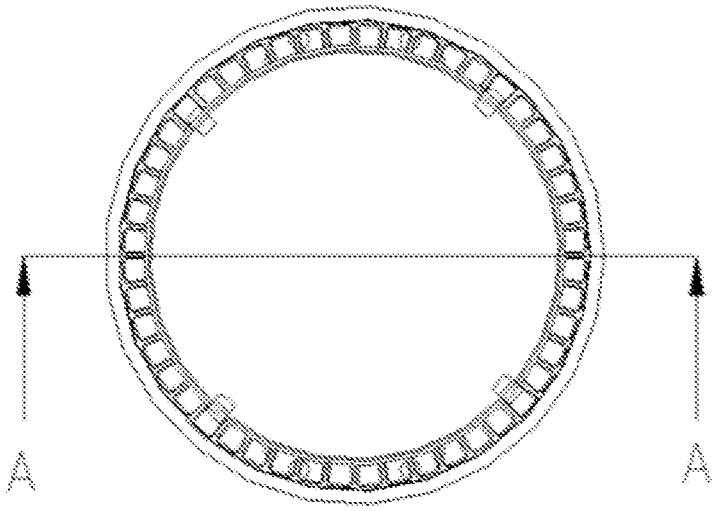
FIG. 5 shows an upward view of the first embodiment of the invention.
Figure 6:
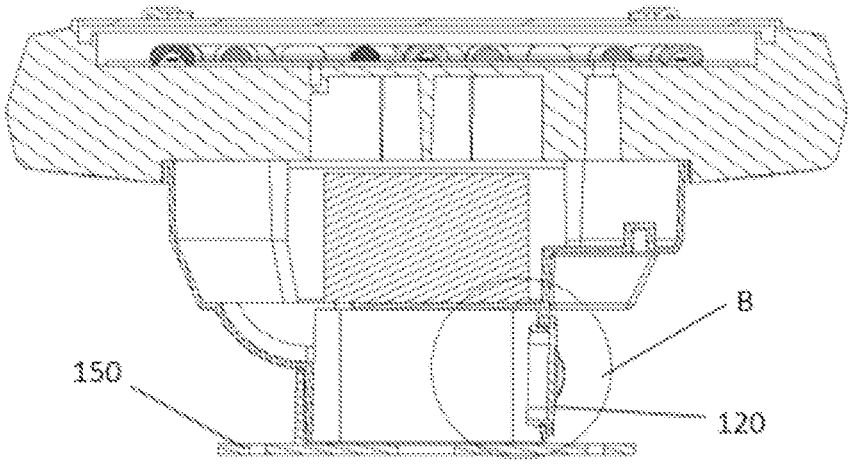
FIG. 6 shows an A-A sectional view of FIG. 5.
Figure 7:
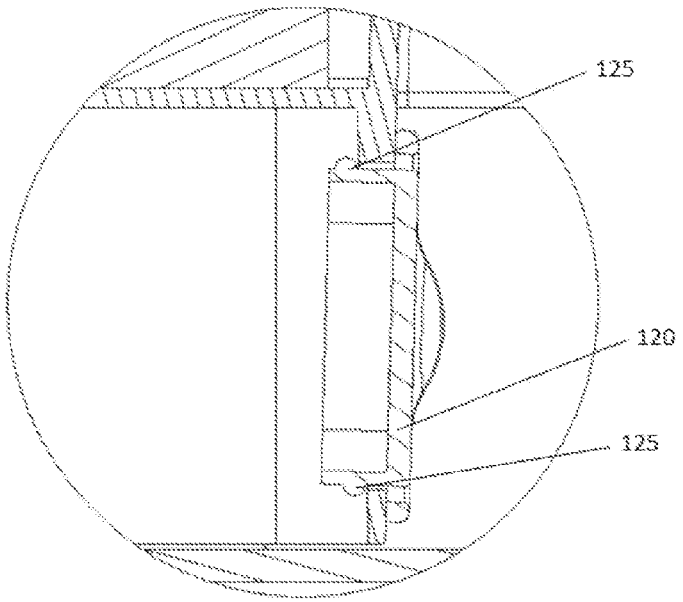
FIG. 7 shows an amplified diagram of Part B in FIG. 6.

In the first preferred embodiment shown in FIG. 5 and FIG. 7, the said light emitting diode luminaire compatible for both top mounting and wall mounting further comprises a square side cover 120 of the mounting adapter body, the two seamed edges thereof are are symmetrically distributed with protruding buckle structures 125; one side of the said mounting adapter racket 130 is provided with a square opening 138; the side covers 120 of the mounting adapter body are fixed to the square opening 138 of the mounting adapter racket 130 via the buckle structures 125.

Figure 9:
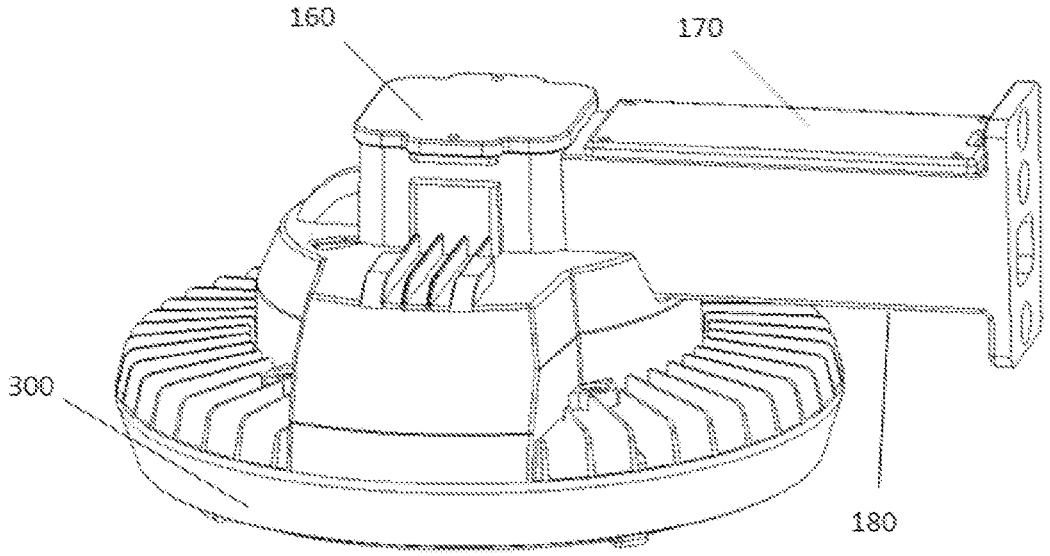
FIG. 9 shows a combined state diagram of the second preferred embodiment of the invention.

FIG. 9 shows the second preferred embodiment of the invention, wherein the said mounting adapter body 100 comprises a mounting adapter racket 130 centered thereof, the said mounting adapter racket 130 is fixedly connected to the sucking plate 150 or arm 180 via fasteners. When this embodiment applies to wall mounting of the light emitting diode luminaire, the said mounting adapter body 100 is fixedly connected to the arm 180, and the light emitting diode luminaire is fixed to the wall mounting surface via the arm 180. The said mounting adapter body 100 further comprises a rectangular wall bracket cover 170 for covering the upper opening of the arm 180 and a wire cover 160 for covering the upper opening of the mounting adapter bracket 130; one end of the said arm 180 is fixedly connected to the mounting adapter racket 130 via fasteners; while the other end of the said arm 180 is arranged with wall mounting fixed holes 185 for fixing the arm 180 to the installation wall surface.

Figure 10:
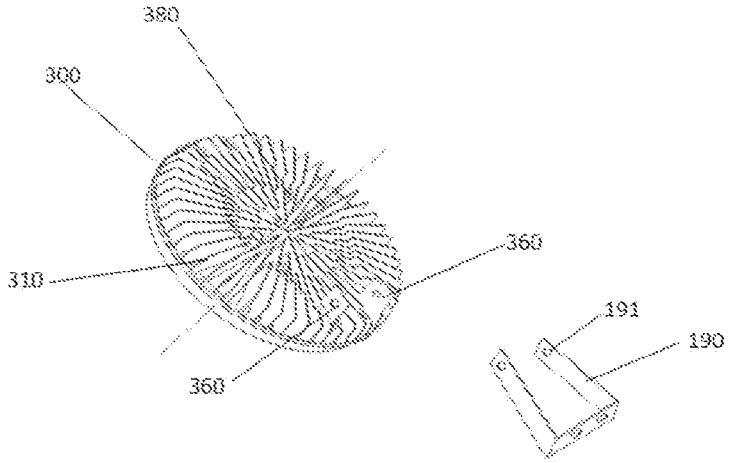
FIG. 10 shows a decomposed state diagram of part of the components of the third preferred embodiment of the invention, only the radiator 300 and mounting bracket 190 are included.

FIG. 10 shows the third preferred embodiment of the invention, wherein the said luminaire body mounting adapter body 100 further comprises a mounting bracket 190; the said radiator 300 further comprises a pair of mounting bracket fastening lugs 360 for fixing the mounting bracket 190; the said mounting bracket 190 is fixed to the said radiator 300 via the mounting bracket fastening lugs 360. The said mounting bracket 190 can be U-shaped or V-shaped, the mounting bracket 190 comprises bracket adaptive holes 191; the fastener fixes the said radiator 300 to the mounting bracket 190 via the said bracket adaptive holes 191 and fixed holes on the mounting bracket fastening lugs 360.

Figure 11:
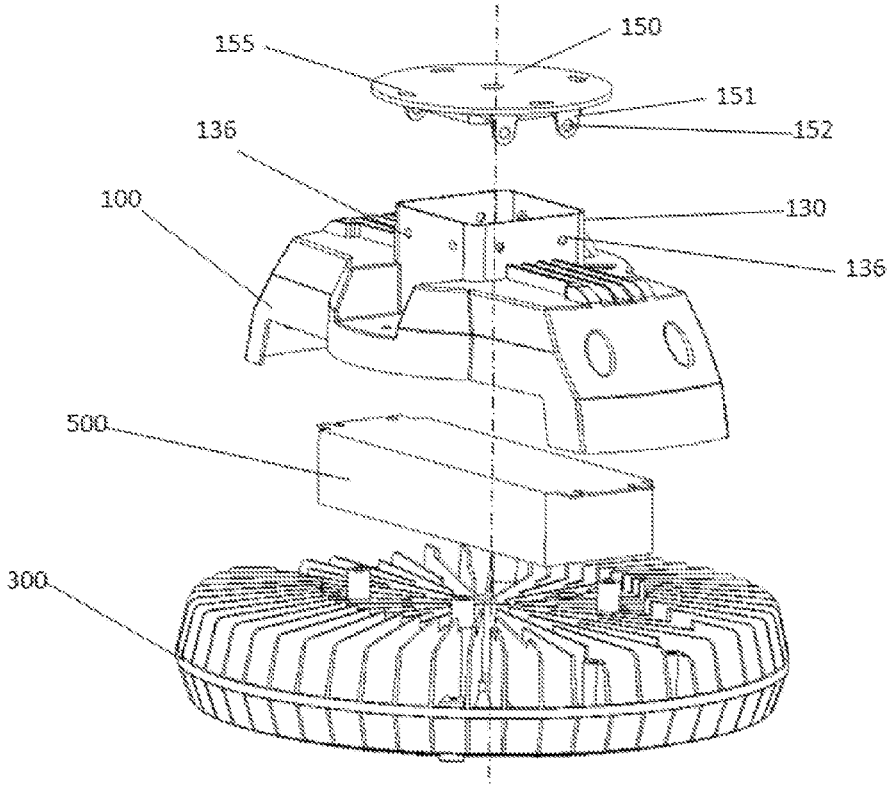
FIG. 11 shows a decomposed state diagram of the fourth preferred embodiment of the invention.
Figure 12:
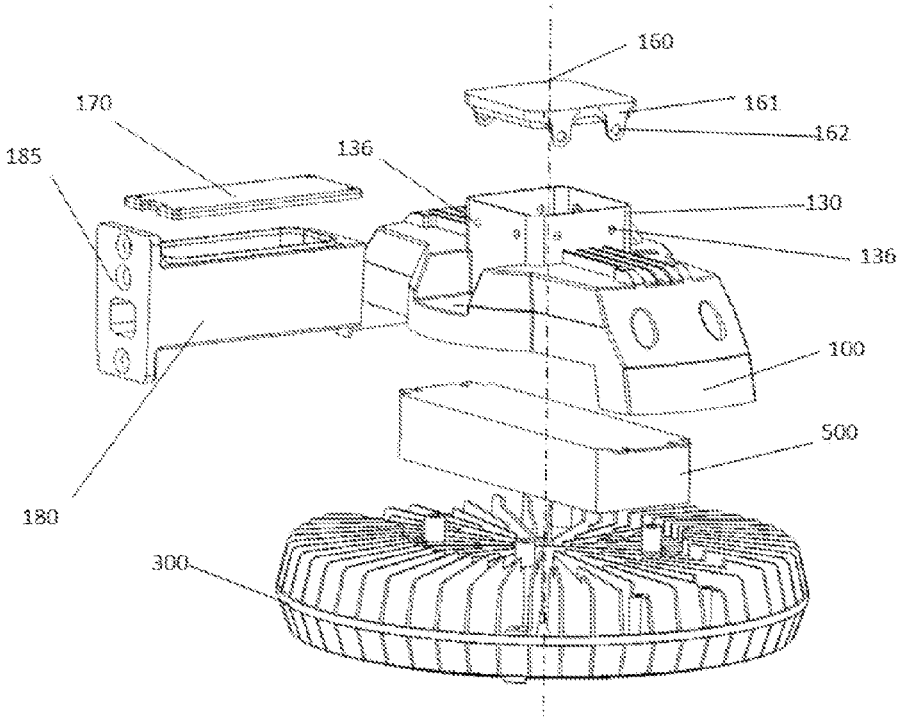
FIG. 12 shows a decomposed state diagram of the fifth preferred embodiment of the invention.
Figure 13:
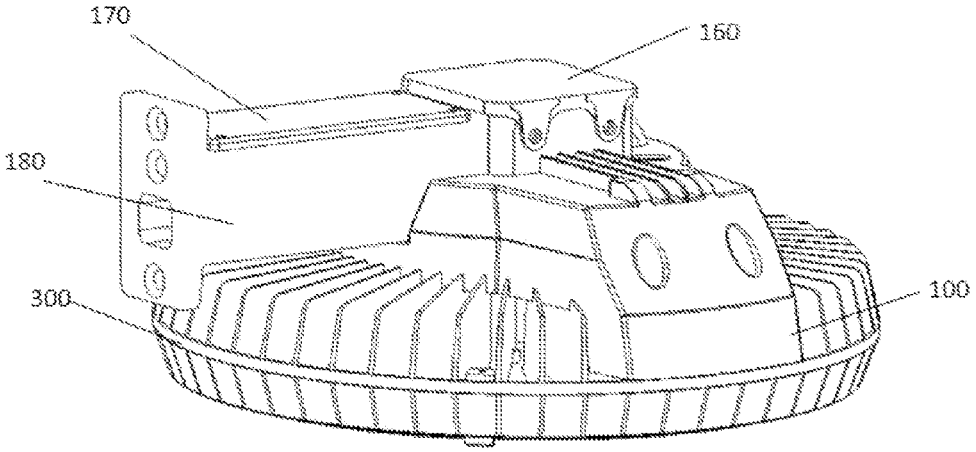
FIG. 13 shows a combined state diagram of the fifth preferred embodiment of the invention.

In the fourth preferred embodiment shown in FIG. 11, the long striped mounting adapter body 100 comprises a mounting adapter racket 130 bracket 130 centered thereof, and mounting screw holes 136 which are distributed at the upper part of the mounting adapter racket 130 bracket 130 and which are connected to the top mounting components or bracket components. Lower surface of the sucking plate 150 comprises protrusion portions 151 which are equipped with connecting screw holes 152; the connecting screw holes 152 on the said protrusion portions 151 are connected to the mounting screw holes 136 on the mounting adapter racket 130 bracket 130 via interconnecting pieces, thus the sucking plate 150 is mounted and fixed to the mounting adapter bracket 130; the top mounting surface of the said sucking plate 150 is arranged with top mounting through holes 155 for fixing the light emitting diode luminaire to the mounting surface. In the fifth preferred embodiment of the invention shown from FIG. 12 to FIG. 13, it further comprises a arm 180 for wall mounting of the light emitting diode luminaire, a rectangular arm cover 170 for covering the upper opening of the arm and a wire cover 160 for covering the upper opening of the mounting adapter bracket 130; one end of the said arm 180 comprises connecting screw holes for connecting the arm 180 to the mounting adapter bracket 130; the said arm 180 is fixedly connected to the mounting adapter racket 130 via interconnecting pieces; while the other end of the said arm 180 is arranged with wall mounting fixed holes 185 for fixing the arm 180 to the installation wall surface. Lower surface of the said wire cover 160 is arranged with wire cover protrusion portions 161, which are equipped with wire cover connecting screw holes 162 connected to the mounting screw holes 136 on the mounting adapter racket 130 bracket 130 via interconnecting pieces, thus the wire cover 160 is mounted and fixed to the mounting adapter bracket 130.

Figure 14:
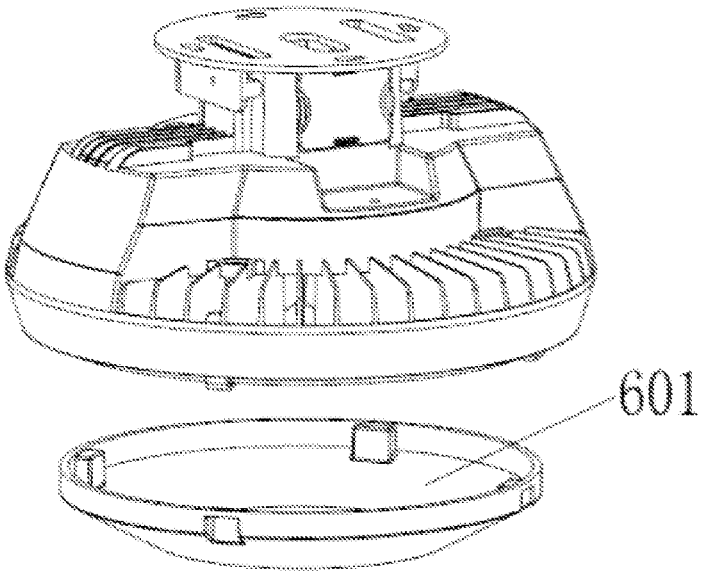
FIG. 14 shows a decomposed state diagram of the sixth preferred embodiment of the invention.

In some of the above embodiments, the transparent lampshade 600 is transparent disk shaped; besides, the said transparent lampshade 600 can also be transparent conical shaped forming different embodiments. The transparent lampshade 600 in the sixth embodiment as is shown in FIG. 14 is the transparent conical lampshade 601. Based on some of the above embodiments, a lens 800 light angles of which can be varied can also be increased to form new embodiments, and the said lens 800 is mounted and fixed between the said transparent lampshade 600 and the light emitting diode light source plate 400. Namely, based on each embodiment, not only lens 800 with various light angles can be varied, but transparent lampshade can be varied, to meet the needs of various applications.

It further comprises a transparent lampshade 600 for covering the luminaire, and a lampshade fixing connector 700 for fixing the transparent lampshade; the said transparent lampshade 600 is fixed to the radiator 300 via the lampshade fixing connector 700; the said radiator 300 comprises a radiator mounting hole post 380 for fixing the radiator, a light source mounting surface 320 located at the bottom of the radiator and heat sinks 310 distributed at the top of the radiator; the said radiator 300 is fixedly connected to the luminaire body mounting adapter body 100 via the radiator mounting hole post 380; the said light emitting diode light source plate 400 is fixed to the light source mounting surface 320 at the bottom of the radiator 300. In some of the above embodiments, the said radiator conducts convection-type heat dissipation via through-holes. The said radiator 300 comprises a radiator mounting fixing hole post for fixing the radiator, a light source mounting surface 320 located at the bottom of the radiator and heat sinks 310 distributed at the top of the radiator. The said power source 500 is fixed to the mounting adapter body 100. The said light emitting diode light source plate 400 is tightly mounted and fixed to the light source mounting surface 320 at the bottom of the radiator 300. The said transparent lampshade 600 is fixed to the radiator 300 via the lampshade fixing connector 700. The said radiator 300 is fixedly connected to the mounting adapter body 100 via the radiator mounting hole post 380.

In some of the above embodiments, the said heat sinks 310 are radially distributed by the center of the radiator 300, and there are convection-type heat dissipation through-holes between the adjacent heat sinks 310; the said lampshade fixing connector 700 comprises a silicon ring 710 and buckles 720; The inner edge of bottom surface of the said radiator 300 is arranged with a silicon ring fixing slot 370 for fixing the silicon ring 710; the light emitting diode light source plate 400 is covered by the said transparent lampshade 600, the said transparent lampshade 600 is compressed to the silicon ring 710 which is embedded into the silicon ring fixing slot 370, and the transparent lampshade 600 is fixedly connected to the radiator 300 via screws or buckles 720.

In some of the above embodiments, it further comprises a lens 800 installed on the light emitting diode light source plate 400, light angles of which can be varied. The silicon ring 710 is mounted in the silicon ring fixing slot 370 of the radiator 300, the light emitting diode light source plate 400 and lens 800 are covered by the transparent lampshade 600; the said transparent lampshade 600 is compressed on the silicon ring 710, mounted and fixed on the radiator with screws or buckles, to avoid the entry of water and dust.

In some of the above embodiments, based on the mounting adapter body 100, top mounting, wall mounting, rack mounting and other ways of mounting can be realized with only one main component by means of adding and expanding part adapting components. Moreover, for rack mounting mentioned above, angle of both the luminaire and the fixed rack can be adjusted, which is a rotatable rack mounting method. Different ways of mounting such as top mounting, wall mounting, fixed mounting or rack mounting with adjustable angles can be selected flexibly as practical applications.

The above-mentioned are only the embodiments of this invention, not to restrict the patent scope of the invention therefore. Equivalent structure or process transformations made out with the specification or content of attached figures of the invention, which are directly or indirectly applied to other related technical fields should fall into the scope of patent protection of this invention in a similar way.

What is claimed is:

1. A light emitting diode luminaire compatible for both top mounting and wall mounting, comprising a mounting adapter body capable for top mounting and wall mounting of a main body of the light emitting diode luminaire, a power source for converting an external power supply into a supply voltage of the luminaire, a radiator for heat dissipation of the luminaire, and a light emitting diode light source plate for effecting illumination of the light emitting diode luminaire; wherein the light emitting diode luminaire further comprises a sucking plate for fixing the main body of the light emitting diode luminaire to a mounting surface by top mounting and/or an arm for fixing the main body of the light emitting diode luminaire to the mounting surface by wall mounting;

the mounting adapter body comprises a mounting adapter bracket at a center of the mounting adapter body, the mounting adapter bracket capable of being connected to the sucking plate and capable of being connected to the arm;

wherein an upper part of the mounting adapter bracket is provided with sucking plate mounting slots for being connected to the sucking plate; a lower surface of the sucking plate is provided with two rectangular facades which are perpendicular to the sucking plate; the two rectangular facades are provided with sucking plate mounting beams which are protruding towards a center of the sucking plate; the sucking plate mounting beams capable of sliding from one end of the sucking plate mounting slots and to clamp into the sucking plate mounting slots.

2. The light emitting diode luminaire compatible for both top mounting and wall mounting according to claim 1, wherein the sucking plate mounting beams are provided with fixing holes.

3. The light emitting diode luminaire compatible for both top mounting and wall mounting according to claim 1, further comprising a square side cover of the mounting adapter body, two seamed edges thereof symmetrically distributed with protruding buckle structures; one side of the mounting adapter bracket is provided with a square opening;

wherein the side cover of the mounting adapter body is fixed to the square opening via buckle structures.

4. The light emitting diode luminaire compatible for both top mounting and wall mounting according to claim 1, wherein the mounting adapter bracket is fixedly connected to the sucking plate and the arm via fasteners.

5. The light emitting diode luminaire compatible for both top mounting and wall mounting according to claim 1, wherein the mounting adapter body further comprises a rectangular arm cover for covering an upper opening of the arm and a wire cover for covering an upper opening of the mounting adapter bracket;

one end of the arm is connected to the mounting adapter bracket via fasteners; the other end of the arm is provided with wall mounting fixing holes for fixing the arm to an installation wall surface.

6. The light emitting diode luminaire compatible for both top mounting and wall mounting according to claim 1, wherein the mounting adapter body further comprises a mounting bracket;

the radiator further comprises a pair of fastening lugs for fixing the mounting bracket;

the mounting bracket is fixed to the radiator via the fastening lugs.

7. The light emitting diode luminaire compatible for both top mounting and wall mounting according to claim 1, wherein the light emitting diode luminaire further comprises a transparent lampshade for covering the luminaire, and a lampshade fixing connector for fixing the transparent lampshade; the transparent lampshade is fixed to the radiator via a lampshade fixing connector; the radiator is fixedly connected to the mounting adapter body; and the power source is fixed to the mounting adapter body;

the radiator comprises a radiator mounting hole post for fixing the radiator, a light source mounting surface located at a bottom of the radiator, and heat sinks distributed at a top of the radiator; the radiator is fixedly connected to the mounting adapter body via the radiator mounting hole post; the light emitting diode light source plate is fixed to the light source mounting surface at the bottom of the radiator.

8. The light emitting diode luminaire compatible for both top mounting and wall mounting according to claim 7, wherein the heat sinks are radially distributed by a center of the radiator, and convection-type heat dissipation through holes are provided between the adjacent heat sinks;

the lampshade fixing connector comprises a silicon ring and buckles;

an inner edge of a bottom surface of the radiator is arranged with a silicon ring fixing slot for fixing the silicon ring; the light emitting diode light source plate is covered by the transparent lampshade, the transparent lampshade is compressed to the silicon ring which is embedded into the silicon ring fixing slot, and the transparent lampshade is fixedly connected to the radiator via the buckles.

9. The light emitting diode luminaire compatible for both top mounting and wall mounting according to claim 7, wherein the light emitting diode luminaire further comprises a lens, light angles of which can be varied, the lens is fixed between the transparent lampshade and the light emitting diode light source plate; the transparent lampshade is cone- or disk-shaped.

* * * * *